US009175400B2

(12) United States Patent
Yau et al.

(10) Patent No.: US 9,175,400 B2
(45) Date of Patent: Nov. 3, 2015

(54) IMMERSION TIN SILVER PLATING IN ELECTRONICS MANUFACTURE

(75) Inventors: Yung-Herng Yau, Allentown, PA (US); Xingping Wang, Frederick, MA (US); Cai Wang, Milford, CT (US); Robert Farrell, Lyme, CT (US); Pingping Ye, Bethany, CT (US); Edward J. Kudrak, Jr., Morganville, NJ (US); Karl F. Wengenroth, Stratford, CT (US); Joseph A. Abys, Guilford, CT (US)

(73) Assignee: Enthone Inc., West Haven, CT (US)

( * ) Notice: Subject to any disclaimer, the term of this patent is extended or adjusted under 35 U.S.C. 154(b) by 958 days.

(21) Appl. No.: 12/607,375

(22) Filed: Oct. 28, 2009

(65) Prior Publication Data

US 2011/0097597 A1 Apr. 28, 2011

(51) Int. Cl.
*C23C 18/54* (2006.01)
*C23C 18/48* (2006.01)

(52) U.S. Cl.
CPC ..... *C23C 18/54* (2013.01); *C23C 18/48* (2013.01); *Y10T 428/12715* (2015.01)

(58) Field of Classification Search
CPC ..... C23C 18/54
USPC ..... 205/85
See application file for complete search history.

(56) References Cited

U.S. PATENT DOCUMENTS

| | | | | |
|---|---|---|---|---|
| 3,294,578 | A | 12/1966 | Popeck | |
| 3,303,029 | A | 2/1967 | Shipley | |
| 4,170,525 | A * | 10/1979 | Kirman et al. | 428/650 |
| 4,657,632 | A | 4/1987 | Holtzman et al. | |
| 4,749,626 | A | 6/1988 | Kadija et al. | |
| 4,816,070 | A | 3/1989 | Holtzman et al. | |
| 4,882,202 | A | 11/1989 | Holtzman et al. | |
| 5,576,053 | A | 11/1996 | Senda et al. | |
| 6,099,713 | A | 8/2000 | Yanada et al. | |
| 6,361,823 | B1 | 3/2002 | Bokisa et al. | |
| 6,508,927 | B2 | 1/2003 | Yanada et al. | |
| 6,579,591 | B2 | 6/2003 | Bishop et al. | |
| 6,607,653 | B1 | 8/2003 | Tsuji et al. | |
| 6,720,499 | B2 | 4/2004 | Bokisa et al. | |
| 6,773,568 | B2 | 8/2004 | Egli et al. | |
| 6,821,323 | B1 | 11/2004 | Bell et al. | |
| 6,860,925 | B2 | 3/2005 | Soutar et al. | |
| 6,911,068 | B2 | 6/2005 | Cobley et al. | |
| 6,998,036 | B2 | 2/2006 | Dietterle et al. | |
| 7,029,761 | B2 | 4/2006 | Kawaguchi et al. | |
| 7,056,448 | B2 | 6/2006 | Okuhama et al. | |
| 7,151,049 | B2 | 12/2006 | Beica et al. | |
| 7,166,152 | B2 | 1/2007 | Okuhama et al. | |
| 7,265,046 | B2 | 9/2007 | Kondo et al. | |
| 7,273,540 | B2 | 9/2007 | Sonoda et al. | |
| 7,527,872 | B2 * | 5/2009 | Steele et al. | 428/447 |
| 7,713,859 | B2 | 5/2010 | Richardson et al. | |
| 2006/0055054 | A1 | 3/2006 | Kondo et al. | |
| 2006/0113006 | A1 | 6/2006 | Masuda et al. | |
| 2006/0202327 | A1 * | 9/2006 | Den Ouden | 257/723 |
| 2007/0037377 | A1 | 2/2007 | Richardson et al. | |
| 2007/0054138 | A1 | 3/2007 | Lau et al. | |
| 2007/0284258 | A1 * | 12/2007 | Yoshimoto et al. | 205/263 |
| 2008/0173550 | A1 | 7/2008 | Kiso et al. | |

FOREIGN PATENT DOCUMENTS

| | | | |
|---|---|---|---|
| JP | 2000309876 | A | 11/2000 |
| JP | 2009155703 | A | 7/2009 |
| JP | 2009185358 | A | 8/2009 |
| JP | 2009191335 | A | 8/2009 |

OTHER PUBLICATIONS

F. A. Lowenheim, Electroplating, McGraw-Hill Book Company, New York, 1978, pp. 410-413.*
F. A. Lowenheim, Electroplating, McGraw-Hill Book Company, 1978, Table of Contents, pp. 389, 410-415.*
F. A. Lowenheim, Electroplating, McGraw-Hill Book Company, New York, 1978, pp. 389-391.*
Abstract of JP2009155703; Jul. 16, 2009.
Abstract of JP2000309876; Nov. 7, 2000.
International Search Report, PCT/US2010/054413, dated Feb. 28, 2013, 5 pages.
Written Opinion, PCT/US2010/054413, dated Feb. 28, 2013, 7 pages.
International Preliminary Report on Patentability, PCT/US2010/054413, dated Mar. 12, 2013, 9 pages.
Abstract of JP2009191335; Aug. 27, 2009.
Abstract of JP2009185358; Aug. 20, 2009.

* cited by examiner

*Primary Examiner* — Bryan D. Ripa
(74) *Attorney, Agent, or Firm* — Senniger Powers LLP

(57) ABSTRACT

A method is provided for depositing a whisker resistant tin-based coating layer on a surface of a copper substrate. The method is useful for preparing an article comprising a copper substrate having a surface; and a tin-based coating layer on the surface of the substrate, wherein the tin-based coating layer has a thickness between 0.5 micrometers and 1.5 micrometers and has a resistance to formation of copper-tin intermetallics, wherein said resistance to formation of copper-tin intermetallics is characterized in that, upon exposure of the article to at least seven heating and cooling cycles in which each cycle comprises subjecting the article to a temperature of at least 217° C. followed by cooling to a temperature between about 20° C. and about 28° C., there remains a region of the tin coating layer that is free of copper that is at least 0.25 micrometers thick.

16 Claims, 10 Drawing Sheets

IMMERSION TIN SILVER PLATING IN ELECTRONICS MANUFACTURE

FIELD OF THE INVENTION

The present invention generally relates to compositions and methods for plating tin-based coating layers by immersion plating.

BACKGROUND OF THE INVENTION

Immersion-plated tin has been used as one of the alternative final finishes for printed wiring board (PWB) because it provides a uniform metallic coating for improved in-circuit-test (ICT) probe life, lubricity for press fit pins, and excellent solderability. Because of the strong affinity between copper and tin, inter-diffusion occurs spontaneously even at room temperature through bulk, grain boundary, and surface diffusion pathways, resulting in the formation of intermetallic compounds at the Sn/Cu interface as well as in the grain boundaries of tin-based coating layers. See C. Xu, et al., "*Driving Force for the Formation of Sn Whiskers*," IEEE TRANSACTIONS ON ELECTRONICS PACKAGING MANUFACTURING, VOL. 28, NO. 1, January 2005. At room temperature, the primary intermetallic is the η phase ($Cu_6Sn_5$) and grain boundary diffusion is significantly faster than bulk diffusion. See B. Z. Lee and D. N. Lee, "*Spontaneous Growth Mechanism of Tin Whiskers," Acta Mater.*, vol. 46, pp. 3701-3714, 1998. This results in irregular growth of $Cu_6Sn_5$ in the grain boundaries of the Sn deposit. Cu diffusion into the grain boundaries of tin deposit combined with intermetallic compound formation creates a compressive stress within the tin deposit. This compressive stress increases with time, and in the presence of surface defects or strain mismatch, creates conditions conducive to tin's breaking through the oxide layer and forming a whisker. See K. N. Tu, "*Irreversible Processes of Spontaneous Whisker Growth in Bimetallic Cu—Sn Thin-Film Reactions" Phys. Rev. B*, vol. 49, pp. 2030-2034, 1994. Tin whiskers pose a major potential for catastrophic electrical short circuit failures between fine pitch circuits in high reliability systems such as heart pacemakers, spacecraft, or military weapons and radars. See F. W. Verdi, "*Electroplated Tin and Tin Whiskers in Lead Free Electronics*," American Competitiveness Institute, November 2004.

The formation of intermetallic compounds (both η phase and ϵ ($Cu_3Sn$) phase) consumes the free tin in the coating that is essential for good solderability. Thus, to ensure sufficient useable "free" tin at assembly, the minimum immersion tin deposit thickness of 1 micrometer is specified by IPC-4554. See IPC-4554 *"Specification for Immersion Tin Plating for Printed Circuit Boards,"* 2007, IPC Bannockburn, Ill. As the soldering temperature increases with the use of lead-free solders, some OEMs even ask for a minimum of 1.2 micrometer.

SUMMARY OF THE INVENTION

Briefly, the present invention is directed to a method for depositing a whisker resistant tin-based coating layer on a surface of a copper substrate. The method comprises contacting the surface of the copper substrate with an immersion tin plating composition. The composition comprises a source of $Sn^{2+}$ ions sufficient to provide a concentration of $Sn^{2+}$ ions between about 5 g/L and about 20 g/L; a source of $Ag^+$ ions sufficient to provide a concentration of $Ag^+$ ions between about 10 ppm and about 24 ppm; a source of sulfur-based complexing agent sufficient to provide a concentration of sulfur-based complexing agent between about 60 g/L and about 120 g/L; a source of hypophosphite ion sufficient to provide a concentration of hypophosphite ion between about 30 g/L and about 100 g/L; a source of anti-oxidant sufficient to provide a concentration of anti-oxidant between about 30 g/L and about 110 g/L; a source of pyrrolidone sufficient to provide a concentration of pyrrolidone of at least about 12 g/L; and an acid in a concentration sufficient to lower the pH of the composition between about 0 and about 5.

The present invention is further directed to an article comprising a copper substrate having a surface; and a tin-based coating layer on the surface of the substrate, wherein the tin-based coating layer has a thickness between 0.5 micrometers and 1.5 micrometers and has a resistance to formation of copper-tin intermetallics, wherein said resistance to formation of copper-tin intermetallics is characterized in that, upon exposure of the article to at least seven heating and cooling cycles in which each cycle comprises subjecting the article to a temperature of at least 217° C. followed by cooling to a temperature between about 20° C. and about 28° C., there remains a region of the tin-based coating layer that is free of copper that is at least 0.25 micrometers thick.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE EMBODIMENT(S) OF THE INVENTION

Figure 1:
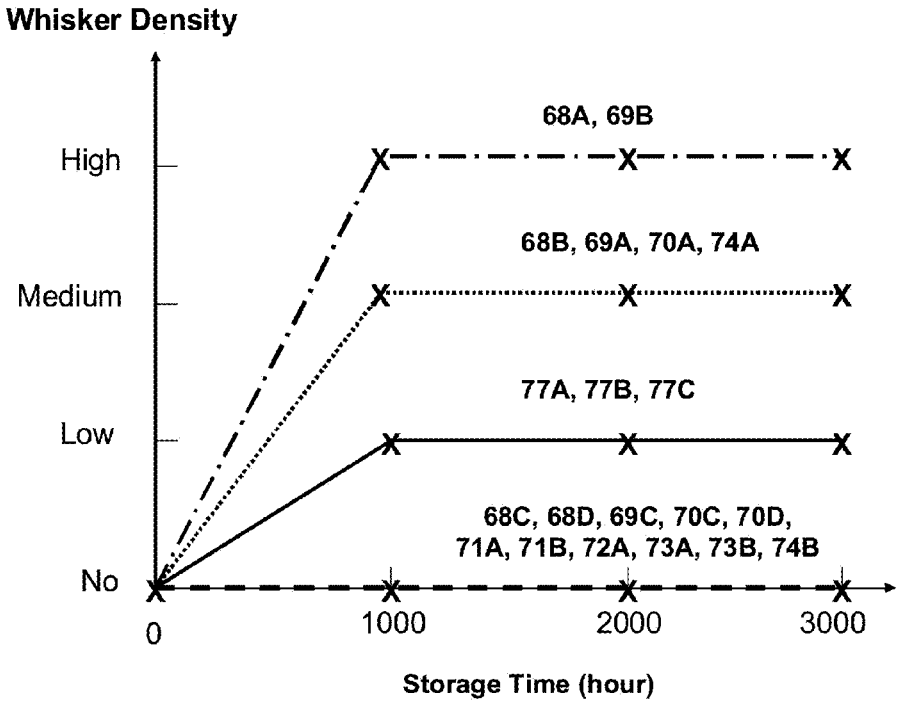
FIG. 1 is a graphical depiction of the whisker density rating of tin-based coating layers deposited according to the several of the Examples.

The present invention is directed to a method and composition for depositing a tin-based coating layer on a metal substrate by immersion plating. In some embodiments, the present invention is directed to a method and composition for depositing a tin-silver alloy coating layer on a metal substrate by immersion plating. In some embodiments, the present invention is directed to a method and composition for depositing a tin-silver alloy as a final finish on a copper substrate in a printed wiring board, the final finish comprising a tin-silver alloy deposited from a composition by immersion plating.

The method of the present invention is capable of depositing an immersion tin-based coating layer on a metal substrate, e.g., a copper substrate, in a reasonably short time, i.e., in some embodiments, the method deposits a tin-based coating layer having a thickness of at least about 1 micrometer in about 9 minutes. In some embodiments, the method deposits a tin-based coating layer having a thickness of at least about 1.2 micrometer in about 9 minutes. Plating rates, therefore, using the method of the present invention may exceed about 0.1 micrometers/minute, about 0.13 micrometers/minute, or even about 0.15 micrometers/minute. Minimizing the duration of substrate exposure to the immersion tin plating solution is advantageous since the plating solution may potentially harm the solder mask, especially at high process temperatures.

Relatively rapid deposition is not the only consideration, however, in formulating a composition for immersion deposition of a tin-based coating layer. In embodiments wherein the tin-based coating layer will be deposited on a metal having different physical and chemical properties than tin, e.g., copper, long term stability, and solderability of the immersion-plated tin-based coating layer are also considerations.

In embodiments wherein, for example, the tin-based coating layer is deposited over copper, tin whiskers may form over time due to the mismatch in coefficients of thermal expansion between tin and copper. When tin-coated copper is subjected to a change in temperature, the tin coating expands or contracts differently than the Cu substrate due to the mismatch in the coefficients of thermal expansion (CTE), i.e., $22\times10^{-6}$ $K^{-1}$ for Sn and $13.4\times10^{-6}$ $K^{-1}$ for Cu. As the temperature of an article comprising a copper substrate and a tin-based coating layer on a surface thereof increases, tin expands more than the copper substrate, resulting in a compressive stress within the tin coating. As the temperature of an article comprising a copper substrate and a tin-based coating layer on a surface thereof decreases, tin contracts more than copper substrate, resulting in a tensile stress within the tin-based coating layer. An article comprising a tin-based coating layer on a surface of a copper substrate may be subjected to alternating compressive stress and tensile stress during a thermal cycling. The compressive stress in the tin-based coating layer is recognized as one driving force for whiskering.

Another driving force in the formation of tin whiskers in a tin-based coating layer on a metallic substrate is the formation of intermetallic compounds in the coating and mismatch of the coefficients of thermal expansion between the coating, the intermetallic compounds that form between the coating and the substrate, and the substrate itself. Intermetallic compound formation yields a compressive stress distribution or gradient in the coating that depends on the thickness the coating. That is, the gradient distribution becomes an important contributor to tin whisker formation in a relatively thin coating, but thick coatings may be whisker resistant since the properties of a relatively thick tin-based coating layer approximate those of a "chunk" of tin.

In embodiments of the present invention wherein the immersion tin-based coating layer, e.g., a tin-silver alloy layer, is deposited as a relatively thin coating on a metal-based substrate, for example, a copper substrate, the tin-based coating layer deposited as a coating over the metal substrate according to the method of the present invention remains free of tin whiskers for an extended duration, e.g., at least about 1000 hours of exposure to ambient temperature, humidity, and environment, at least about 2000 hours of exposure to ambient temperature, humidity, and environment, or even longer, such as at least about 3000 hours of exposure to ambient temperature, humidity, and environment. The tin-based coating layer may have a thickness of between about 0.5 micrometers and about 1.5 micrometers, such as between about 0.7 micrometers and about 1.2 micrometers, or even between about 0.7 micrometers and about 1.0 micrometer. The relatively thin tin-based coating layer having a thickness within these ranges remains free of tin whiskers for an extended duration, e.g., at least about 1000 hours, 2000 hours, at least 3000 hours, or even at least about 4000 hours of exposure to ambient temperature, humidity, and environment.

In embodiments wherein the immersion-plated tin-based coating layer, e.g., a tin-silver alloy layer, is deposited as a coating on a metal-based substrate, for example, a copper substrate, the tin-based coating layer deposited according to the method of the present invention remains free of tin whiskers after multiple thermal cycles in which the tin-based coating layer is exposed to extremes in temperature. The tin-based coating layer may have a thickness of between about 0.5 micrometers and about 1.5 micrometers, such as between about 0.7 micrometers and about 1.2 micrometers, or even between about 0.7 micrometers and about 1.0 micrometers. A tin-based coating layer deposited as a coating within these ranges of thickness on a metal substrate of the present invention remains free of tin whiskers after at least about 1000 thermal cycles in which the tin-based alloy is exposed to −55° C. for at least 10 minutes followed by exposure to 85° C. for at least 10 minutes. In some embodiments, the tin-based coating layer of the present invention deposited as a coating within these ranges of thickness remains free of tin whiskers after at least about 2000 thermal cycles in which the tin-based alloy is exposed to −55° C. for at least 10 minutes followed by exposure to 85° C. for at least 10 minutes. In some embodiments, the tin-based coating layer of the present invention deposited as a coating within these ranges of thickness remains free of tin whiskers after at least about 3000 thermal cycles in which the tin-based alloy is exposed to −55° C. for at least 10 minutes followed by exposure to 85° C. for at least 10 minutes.

In some embodiments, moreover, the method of the present invention deposits a tin-based coating layer on, for example, a copper substrate that remains solderable through multiple lead-free reflow cycles, such as at least about 5 lead-free reflow cycles, at least about 7 lead-free reflow cycles, at least about 9 lead-free reflow cycles, at least about 11 lead-free reflow cycles, at least about 13 lead-free reflow cycles, or even at least about 15 lead-free reflow cycles.

The breakdown of solderability and the formation of tin whiskers are attributable to the formation of intermetallic compounds (IMC) in the Sn/Cu interface. Because of the spontaneous inter-diffusion between Sn and Cu atoms, the formation of IMCs is inevitable. Once the "free" tin is consumed by IMC formation, the coating becomes unsolderable. IMC formation is temperature dependent; the rate of IMC formation increases with increasing temperature. Tin-based coatings of the present invention can sustain the high temperatures of a typical reflow process and resist IMC formation and whiskering. Moreover, the coating remains solderable, suggesting the presence of free tin on the surface after multiple reflows.

In some embodiments, solderability is maintained in the tin-based coating layer of the present invention by depositing a tin-based coating layer in which a surface region that is free of such Sn—Cu intermetallic compounds extends at least about 0.1 micrometers from the surface of the tin-based coating layer toward the substrate after at least three lead-free reflow cycles that approximate the temperatures of a typical PWB assembly step. In some embodiments, solderability is maintained by the deposition of a tin-based coating layer that resists the migration of copper into the tin-based coating layer during multiple lead-free reflow cycles, e.g., at least three lead-free reflow cycles. Preferably, the surface region that is free of copper extends at least about 0.1 micrometers from the surface of the tin-based coating layer toward the substrate after at least three lead-free reflow cycles that approximate the temperatures of a typical PWB assembly step. A typical lead-free reflow cycle comprises subjecting the article to a temperature of at least 217° C., such as between about 250° C. and about 260° C., followed by cooling to about room temperature, e.g., between about 20° C. and about 28° C. Typically, the Sn—Cu intermetallic compound free surface region extends at least about 0.1 micrometers after at least five such lead-free reflow cycles, after at least seven such lead-free reflow cycles, after at least nine such lead-free reflow cycles, after eleven of such lead-free reflow cycles, or even after fifteen of such lead-free reflow cycles. In some embodiments, the tin-based coating layer resists the migration of copper into the tin-based coating layer and is thus free of copper through at least five such lead-free reflow cycles, after at least seven such lead-free reflow cycles, after at least nine such lead-free reflow cycles, after eleven of such lead-free reflow cycles, or even after fifteen of such lead-free reflow cycles.

Preferably, the surface region of the tin-based coating layer of the present invention that is free of Cu and/or Sn—Cu intermetallic compounds extends a thickness of at least about 0.25 micrometers from the surface of the tin-based coating layer toward the substrate after at least three lead-free reflow cycles in which each cycle comprises subjecting the article to a temperature of at least 217° C., such as between about 250° C. and about 260° C., followed by cooling to about room temperature, e.g., between about 20° C. and about 28° C., after at least five such lead-free reflow cycles, after at least seven such lead-free reflow cycles, after at least nine such lead-free reflow cycles, after eleven of such lead-free reflow cycles, or even after fifteen of such lead-free reflow cycles.

Even more preferably, the surface region of the tin-based coating layer of the present invention that is free of Cu and/or Sn—Cu intermetallic compounds extend a thickness of at least about 0.35 micrometers from the surface of the tin-based coating layer toward the substrate after at least three lead-free reflow cycles in which each cycle comprises subjecting the article to a temperature of at least 217° C., such as about 260° C. followed by cooling to about room temperature, after at least five such lead-free reflow cycles, after at least seven such lead-free reflow cycles, after at least nine such lead-free reflow cycles, after eleven of such lead-free reflow cycles, or even after fifteen of such lead-free reflow cycles.

Finally, the method of the present invention also deposits tin-based coating layers on copper substrates that are characterized by good adhesion to the substrate as measured by a peel test, a common "qualitative" test used in the industry to evaluate the coating adhesion by scotch tape-pull, in which a rating of 0 to 5 is given depending on how much coating is peeled off by the scotch tape.

The high degree of tin whisker resistance in the tin-based coating layer on a metal substrate, such as a copper substrate, is achieved by including silver ion in the tin deposition bath within a particularly preferred concentration range. The present invention is thus further directed to the deposition of a tin-based coating layer that further comprises silver. In some embodiments, the tin-based coating layer comprises an alloy comprising both tin and silver. Within the context of the present invention, the tin-based coating layer comprises both tin-based alloys and other tin-based composites. Alloys, within the context of the present invention, encompasses tin-based coating layers comprising tin and an alloying metal, such as silver, zinc, copper, bismuth, and the like. Typically, the tin concentration is at least 50 wt. %, at least 70 wt. %, at least 80 wt. %, such as at least 85 wt. %, at least 90 wt. %, and in some embodiments, at least 95 wt. %. Composites, within the context of the present invention, encompass tin-based coating layer comprising tin, optionally an alloying metal, and non-metallic materials including non-metallic elements such as phosphorus, and other non-metallic materials, such as polyfluorinated polymers, for example, polytetrafluoroethylene.

The composition for depositing a tin-based coating layer by immersion plating of the present invention generally comprises a source of $Sn^{2+}$ ions, a source of $Ag^{+}$ ions, a pH adjusting agent, a complexing agent, a rate enhancer, an antioxidant, and a wetting agent.

The source of $Sn^{2+}$ ions may be any salt comprising an anion that does not form substantially insoluble salts with silver ions. In this regard, sources of $Sn^{2+}$ ions include tin sulfate, tin methanesulfonate and other tin alkanesulfonates, tin acetate, and other tin salts that are compatible with silver ions. A preferred source is tin sulfate. Since the displacement reaction between $Sn^{2+}$ ion and Cu metal is controlled by the potential of $Sn^{2+}$ $(Thiourea)_m$ complex and $Cu^{+}$ $(Thiourea)_n$ complex, it is desirable to maintain the concentrations of $Sn^{2+}$ ion, $Cu^{+}$ ion, and thiourea within certain preferred ranges.

In the EMF series, Cu is nobler than Sn, so the exchange reaction does not happen between Sn ions and Cu metal. Thiourea effectively reverses the potentials of Sn and Cu to facilitate the exchange reaction. The potentials of Sn and Cu in solution depend on the concentrations of thiourea, Sn ions, and Cu ions in the plating composition (the Cu ions are not present in the fresh bath but gradually build up as reaction taking place). In general, the higher the concentration of thiourea, the greater the potential difference between Sn and Cu, and therefore the faster the deposition rate. The concentration of thiourea is limited by its solubility in water, around 120 g/L at room temperature. The lower the $Sn^{2+}$ ion concentration, the more thiourea is available to complex Cu ion and creates a higher driving force for the exchange reaction to take place. However, it has been observed that when the concentration of $Sn^{2+}$ ions is less than about 6 g/L (about 10 g/L as $SnSO_4$), the adhesion of the coating decreases. Accordingly, in some embodiments, the source of $Sn^{2+}$ ions is added in a concentration sufficient to provide a concentration of $Sn^{2+}$ ions between about 5 g/L and about 20 g/L, such as between about 6 g/L and about 12 g/L, or between about 6 g/L and about 10 g/L.

The composition for the deposition of a tin-based coating layer of the present invention further comprises a sulfur-based complexing agent for tin ions and copper ions. Preferably, the sulfur-based complexing agent is one that, as described above, is capable of reversing the relative EMF potentials of copper and tin. Useful sulfur-based complexing agents include thiourea, N-allyl thiourea, N-allyl-N'-β-hydroxyethyl-thiourea ("HEAT"), and amidinothiourea, and the like. The sulfur-based complexing agent may be added in a concentration between about 60 g/L and 120 g/L, which is near the solubility limit of the preferred thiourea complexing agent. Preferably, the sulfur-based complexing agent is present in a concentration of at least about 90 g/L, particularly at the beginning of the deposition process since empirical results to date indicate that the desired coating thickness of about 1 micrometer or more may be deposited in about nine minutes at 70° C. when the sulfur-based complexing agent concentration is at least about 90 g/L. Since the immersion reaction mechanism gradually increases the copper ion concentration in the solution, it is preferable to gradually increase the concentration of the complexing agent as deposition continues. Empirical results to date indicate that the sulfur-based complexing agent should be added to the immersion plating composition at a rate of between about 3 g/L and about 9 g/L complexing agent per 1 g of copper ion/L buildup in the immersion tin composition of the present invention, preferably between about 5 g/L and about 7 g/L complexing agent per 1 g of copper ion/L buildup in the immersion tin composition of the present invention, such as about 6 g/L complexing agent per 1 g of copper ion/L buildup in the immersion tin composition of the present invention. Moreover, the effect of the sulfur-based complexing agent on increasing the relative deposition rate is also dependent in part on the concentration of tin ions. The high sulfur-based complexing agent concentration is most effective when the tin ion concentration is relatively low, such as between about 5 g/L and about 10 g/L tin ion. The tin ion concentration should not be too low, however, to adversely affect the adhesion of the tin-based alloy to the substrate.

$Ag^+$ ions are sparingly soluble in water with most anions. Therefore, the source of $Ag^+$ ions is limited to salts of sulfate, acetate, methane sulfonate and other alkane sulfonates, and other silver salts that are substantially soluble in water. A preferred source is silver sulfate. Typically, the concentration of the source of $Ag^+$ ions is sufficient to provide between about 10 ppm and about 24 ppm silver ions, preferably between about 12 ppm and about 24 ppm silver ions, more preferably between about 12 ppm and about 20 ppm silver ions, or in some embodiments between about 10 ppm and about 16 ppm silver ions. In this context, the concentration units "ppm" are in mass:vol units. Therefore, "ppm" herein is equivalent to mg/L. As will be apparent from the below examples, the minimum concentration of silver ions of 10 ppm is critical to achieving tin whisker reduction during long storage under ambient temperature, humidity, and environment. The silver concentration in the composition is preferably less than 24 ppm to avoid an unduly high silver content in the tin-based alloy coating. More specifically, the tin-based coating layer deposited from an immersion tin composition of the present invention comprising between about 10 ppm and about 24 ppm is free of tin whisker growth when stored under ambient conditions, i.e., temperature, humidity, and atmosphere, for at least about 1000 hours, at least about 2000 hours, at least about 3000 hours, or even at least about 4000 hours.

The immersion plating bath of the present invention preferably has an acidic pH. Accordingly, the bath pH is preferably between about 0 and about 5, preferably between about 0.2 and about 1. The choice of acids is limited by the poor solubility or substantial insolubility of most Ag salts. Accordingly, the preferred acidic pH can be achieved using sulfuric acid, methanesulfonic acid and other alkanesulfonic acids, acetic acid, and other acids that do not form insoluble salts with silver ions, and combinations of such acids. In one preferred embodiment, the acid is sulfuric acid. In one preferred embodiment, the concentration of sulfuric acid (98% or more concentrated solution) is between about 20 mL/L to about 100 mL/L, preferably between about 30 mL/L and about 50 mL/L. The concentration of sulfuric acid is preferably kept within these ranges since it has been observed that the coating thickness decreases when the composition comprises less than about 30 mL/L $H_2SO_4$. Stable coating thicknesses are achieved when the composition comprises between about 30 mL/L and about 50 mL/L $H_2SO_4$. Higher acid concentrations are not desirable since that may damage the solder mask.

A source of hypophosphite may be added as a rate enhancer. The source of hypophosphite acts like a rate enhancer to the extent that it acts like a catalyst for deposition of the tin-based coating layer and is not consumed in the deposition process. This is in contrast to a reducing agent, which is normally consumed by an oxidation reaction as it reduces metal ions to metal. Herein, since the hypophosphite is a rate enhancer, it is not consumed, i.e., oxidized, during deposition. Sources of hypophosphite include sodium hypophosphite, potassium hypophosphite, ammonium hypophosphite, and phosphinic acid. Sources that may alter solution pH, such as ammonium hypophosphite and phosphinic acid, are less preferred than sources of hypophosphite that affect the solution pH slightly if at all. The source of hypophosphite may be added at a concentration of at least about 0.45 M, such as between about 0.45 M and about 1.4 M, which provides at least about 30 g/L hypophosphite ion, such as between about 30 g/L and about 100 g/L hypophosphite ion. Sodium hypophosphite is the most preferred rate enhancer. In order to function as a rate enhancer, the sodium hypophosphite concentration is relatively high such as at least about 40 g/L, such as between about 40 g/L and about 120 g/L. Empirical results to date indicate that sodium hypophosphite concentrations between about 70 g/L and about 100 g/L are particularly preferred for achieving rapid tin deposition and thick tin deposits of at least about 1 micrometer after about 9 minutes of deposition.

An anti-oxidant may be added in order to inhibit oxidation of $Sn^{2+}$ ions to $Sn^{4+}$ ions. Examples of suitable antioxidants include glycolic acid (hydroxyacetic acid), gluconic acid, hydroquinone, catechol, resorcin, phloroglucinol, cresolsulfonic acid and salts thereof, phenolsulfonic acid and salts thereof, catecholsulfonic acid and salts thereof, hydroquinone sulfonic acid and salts thereof, hydrazine and the like. Such antioxidants can be used singly or as a mixture of two or more kinds. The concentration of the anti-oxidant may be between about 30 g/L and about 110 g/L, such as between about 40 g/L and about 80 g/L. A preferred anti-oxidant is glycolic acid, commercially available as a 70 wt. % solution. To achieve adequate results, the glycolic acid solution (70 wt. %) may be added to the immersion tin composition at a concentration between 50 mL/L and 150 mL/L, with preferred concentrations from 70 mL/L to about 100 mL/L.

Adding glycolic acid in a glycolic acid solution (70 wt. %) at these volume concentrations provides between about 35 g/L and about 105 g/L glycolic acid, preferably between about 49 g/L and about 70 g/L glycolic acid.

A wetting agent may be employed to enhance the thickness uniformity of the tin-based alloy across the substrate. A source of pyrrolidone is a preferred wetting agent. In this regard, polyvinylpyrrolidone is an especially preferred source of wetting agent. Preferred sources of polyvinylpyrrolidone include Luvitec® K30 and Luvitec® K60 from BASF. The polyvinylpyrrolidone may be added as a powder or as a pre-dissolved solution, typically having a solid concentration of 30 wt. %. In order to produce a uniform coating, the polyvinylpyrrolidone concentration is preferably at least about 12 g/L, such as between about 12 g/L and about 18 g/L, such as between about 12 g/L and about 15 g/L. Another source of wetting agent comprises 1-methyl-2-pyrrolidone, 5-methyl-2-pyrrolidone, or a combination thereof. Preferably, the wetting agent comprises 1-methyl-2-pyrrolidone. In some embodiments, the source of wetting agent comprises a source of 1-methyl-2-pyrrolidone, 5-methyl-2-pyrrolidone, or a combination thereof further in combination with polyvinylpyrrolidone. In some embodiments, the source of wetting agent comprises 1-methyl-2-pyrrolidone in combination with polyvinylpyrrolidone.

Other useful wetting agents include EO/PO copolymers, such as the Pluronics® additives, available from BASF including Pluronic® F127, Pluronic® P103, Pluronic® 123, Pluronic® 104, Pluronic® F87, Pluronic® F38, and the like. These may be added in concentrations of at least 0.01 g/L, such as from about 0.01 g/L to about 3 g/L. Other useful wetting agents include betaine-type wetting agents, such as the RALUFONS® additives, available from Raschig GmbH, such as Ralufon® DL and Ralufon® NAPE, which may be added in a concentration of at least about 0.01 g/L, such as from about 0.01 g/L to about 1 g/L. Also useful as sulfate wetting agents, such as the NIAPROOF® additives, available form Niacet Corporation, including NIAPROOF® 08, which may be added in a concentration of at least about 0.01 g/L such as from about 0.01 g/L to about 1 g/L.

A supplemental complexing agent may be added to the deposition composition to alter the plating rate and/or the silver content of the tin-based alloy. Supplemental complexing agents may be chosen from among amino acids having from 2 to 10 carbon atoms; polycarboxylic acids such as oxalic acid, citric acid, tartaric acid, gluconic acid, malic acid, lactic acid, adipic acid, succinic acid, malonic acid, and maleic acid; amino acetic acids such as nitrilotriacetic acid; alkylene polyamine polyacetic acids such as ethylenediamine tetraacetic acid ("EDTA"), diethylenetriamine pentaacetic acid ("DTPA"), N-(2-hydroxyethyl)ethylenediamine triacetic acid, 1,3-diamino-2-propanol-N,N,N',N'-tetraacetic acid, bis-(hydroxyphenyl)-ethylenediamine diacetic acid, diaminocyclohexane tetraacetic acid, or ethylene glycol-bis-((β-aminoethylether)-N,N'-tetracetic acid); polyamines such as or N,N,N',N'-tetrakis-(2-hydroxypropyl)ethylenediamine, ethylenediamine, 2,2',2"-triaminotriethylamine, triethylenetetramine, diethylenetriamine and tetrakis(aminoethyl)ethylenediamine; and N,N-di-(2-hydroxyethyl)glycine. The supplemental complexing agent may be added in a concentration of at least about 1 g/L, such as between about 1 g/L and about 20 g/L.

Substrates for depositing a tin-based coating layer thereon by immersion plating are typically metallic substrates, such as copper. In a preferred embodiment, the substrate includes copper on a printed wiring board, and the tin-based coating layer is a final finish for PWB. Other substrates include lead frames and connectors in electronic devices, which are also typically coated with copper. The method of the present invention is also applicable for depositing a tin-based coating layer onto a die pad in under bump metallization.

The metal substrate is cleaned and etched using conventional methods prior to treatment. The substrate is microetched to etch the surface and obtain the desired surface texture. Micro-etch compositions, as are known in the art, may contain oxidizing agents such as hydrogen peroxide or persulfate, in addition to acid. As is known, the ratio of oxidizing agent and acid determines the surface texture. Empirical results to date indicate that rougher surfaces are ideal for enhancing the thickness of the tin-based alloy. After the substrate is contacted with the microetch composition (by immersion, cascading, spraying, or any other technique that achieves adequate etching), the substrate is contacted with a pre-dip composition. A pre-dip composition for cleaning the surface and preventing contamination to the tin plating solution by drag-in may comprise sulfuric acid in a concentration between about 1% and about 7% by weight, such as between about 1% and about 5% by weight, or even between about 1% and about 3% by weight, for etching. Empirical evidence to date suggests that the temperature of the pre-dip composition should be between about 20° C. and about 50° C. to achieve an optimum balance of tin alloy layer thickness and uniformity on the substrate. At temperatures higher than about 50° C., thicker deposits have been observed, but these deposits are less uniform than tin layers deposited at temperatures within the preferred range.

After the substrate is contacted with the pre-dip composition (by immersion, cascading, spraying), the substrate is contacted with the tin alloy deposition composition of the invention. Since immersion plating is a self-limiting technique and since prolonged exposure to the deposition composition may adversely affect the solder mask, it is preferred to deposit the tin alloy to a thickness of at least about 1 micrometer, or even at least about 1.2 micrometer within a relatively short exposure duration of the substrate to the plating composition. In this regard, empirical results to date show that a plating time of about 9 minutes in the method according to the present invention achieved the desired tin alloy thickness. Since the desired thickness is typically 1 micrometer, the method of the present invention therefore achieves a plating rate of at least about 0.11 micrometers/minute, such as at least about 0.13 micrometers/minute, or even at least about 0.15 micrometers/minute.

Having described the invention in detail, it will be apparent that modifications and variations are possible without departing from the scope of the invention defined in the appended claims.

EXAMPLES

The following non-limiting examples are provided to further illustrate the present invention.

Sample Plating

In each of the following examples, a common methodology was used to deposit tin-based coating layers on copper coupons by an immersion mechanism. Copper test coupons were prepared according to common process procedures used in applying final finishes as PWB fabrication, i.e., cleaning, rinsing, microetching (1 minute standard, unless otherwise specified), rinsing, pre-dip, plating, rinsing, and drying. To standardize the hydrodynamic conditions in the plating solution, sample coupons were plated manually in beakers with a reciprocal motion at about 1 cycle/second. The dwell time in the plating solution was nine minutes unless specified otherwise.

Tin Thickness Measurement

The tin-based coating layer thickness was measured using X-ray fluorescence (XRF) and Sequential Electrochemical Reduction Analysis (SERA). The XRF measurement was made using the SEA 5210 Element Monitor MX from Seiko Instruments with the L-series X-ray lines for improved accuracy. The SERA test was conducted with the SURFACE-SCAN® QC-100™ from ECI Technology, using a 5% HCl working solution and an Ag/AgCl reference electrode. See P. Bratin et al., "Surface Evaluation of the Immersion Tin Coatings vi Sequential Electrochemical Reduction Analysis (SERA)." The current density was 4500 $\mu A/cm^2$ and the gasket aperture provided a consistent exposed test area of 0.160 cm diameter. The thickness $\eta$ and $\epsilon$ was converted to an "equivalent" thickness of pure tin by using their respective density and composition so that the equivalent "total" thickness of pure tin could be obtained and compared against that measured by XRF. A single test spot was measured on each of the wetting balance test coupons, at the opposite end away from the area that was immersed in the molten solder for the wetting balance tests. In this manner, changes in the relative thicknesses of the "free" Sn and the IMCs induced by successive reflow cycles can be detailed and related to the corresponding wetting balance tests.

Whisker Inspection

An initial inspection was performed under ARMRY 3200C Scanning Electron Microscope (SEM) with a magnification of 200× on coupons immediately after plating. The total area inspected was 75 $mm^2$ according to JESD22A121. See "Test Method for Measuring Whisker Growth and Tin and Tin Alloy Surface Finishes," JEDEC SOLID STATE TECHNOLOGY ASSOCIATION, JESD22A121.01, October 2005. The test coupons were then exposed to ambient temperature/humidity for aging test. After every 1000 hours of aging, the same areas of the test coupons were re-inspected with a magnification of 200× under SEM. If whiskers were not detected during this screening inspection, a detailed inspection was not required at that read out point. If whiskers were detected during the screening inspection, then the detailed inspection was performed on the area with the longest tin whiskers identified in the screening inspection with a magnification of 1000× under SEM. The number of whiskers per unit area (whisker density) was recorded. According to JESD22A121, Sn whisker density is classified into three categories, i.e., Low, Medium, and High. However, to further distinguish samples that did not show any whiskers, a fourth category, "No" was added. The Whisker Density classifications are shown in the following Table 1.

TABLE 1

Ranking of Whisker Density

| Whisker Density | Mean Number of Whiskers per Inspected Coupon area ($mm^2$) |
|---|---|
| No | 0 |
| Low | 1 to 10 |
| Medium | 10 to 45 |
| High | >45 |

Thermal Cycle Test

When tin coated copper is subjected to a change in temperature, the tin-based coating layer expands or contracts differently than the copper substrate due to the mismatch in the coefficients of thermal expansion (CTE), i.e., $22\times10^{-6}$ $K^{-1}$ for tin and $13.4\times10^{-6}$ $K^{-1}$ for copper. At a high temperature, tin expands more than the copper substrate, resulting in a compressive stress within the tin coating. At a low temperature, tin contracts more than copper substrate, resulting in a tensile stress within the tin coating. Therefore, the tin-based coating layer is subjected to alternating compressive-tensile stress during a thermal cycling. The compressive stress in the tin-based coating layer is recognized as the driving force for whiskering and the thermal cycle was developed as an accelerated test to evaluate the resistance of the tin-based coating layer to whiskering. Herein, the thermal cycle test was conducted in a Cincinnati Sub-Zero CSZ Elevator Chamber. In each cycle, the sample was exposed to −55° C. for 10 minutes immediately followed by 10 minutes at 85° C. In essence, it was a thermal "shock" rather than the traditional thermal "cycle" test. Prior to the thermal cycle test, the samples were conditioned with lead-free reflow treatment. The samples were removed for whisker examination after 3000 cycles.

Simulated Assembly Reflow Conditioning

Conditioning of the test coupons was accomplished using a five zone BTU TRS Conveyorized Reflow Unit, utilizing convection and I.R. heating elements. The test coupons were processed through a series of simulated "lead free" assembly reflow cycles. The straight ramp profile had a ramp rate of 1.5° C./second, with a maximum temperature between 250° C. and 260° C., and a time above liquidous (217° C.) of 49 seconds, followed by cooling to room temperature before the next reflow cycle. A single cycle typically takes 5 to 10 minutes. Three sets of twelve wetting balance test coupons coated with each of the immersion Sn coatings were processed through the reflow oven for a maximum of 15 reflow cycles. As a control, two coupons from each coating set were tested without having been reflowed.

Wetting Balance Test

The solderability was evaluated by wetting balance test per IPC/EIA J-STD-003A section 4.3.1 using a 6 Sigma Wetting Balance Solderability Tester from "Robotic Process Systems." See Joint Industry Standard: *Solderability Tests for Printed Boards*, IPC/EIA J-STD-003A, IPC, Bannockburn, Ill. Alpha Metal's EF-8000 rosin flux containing 6% solids, and SAC 305 solder were used with the testing parameters listed in the below Table 2. The custom configured wetting balance test coupons are composed of 0.062 inch double-sided ounce copper foil clad FR-4 laminate plated to 1.0 ounce with electrolytic copper. Relative solderability after conditioning is determined by comparing the wetting curves generated for each coupon.

TABLE 2

Operating Conditions for Wetting Balance Test

| Parameters | Solder Pot | Flux Pot |
|---|---|---|
| Hang time, sec. | 20 | 2 |
| Temperature, ° C. | 260 | Ambient |
| Insert Speed, inches/second | 0.5 | 1 |
| Dwell Time, sec | 10 | 10 |
| Extract Speed, inches/second | 0.5 | 1 |

Example 1

Immersion Tin Plating and Compositions

Copper coupons were prepared for and subjected to immersion tin plating for nine minutes in each of four immersion tin plating compositions designated 68A, 68B, 68C, and 68D that were prepared with varying concentrations of silver ions added. Prior to tin plating, the copper coupons were pre-dipped in a composition comprising sulfuric acid (2% concentration) at a temperature of 24° C. The immersion tin plating compositions were held at a temperature of about 70° C. during immersion tin silver plating. Each of the four immersion tin plating compositions contained the following components in the concentrations shown:

Tin Sulfate (12 g/L, to provide about 6.6 g/L of $Sn^{2+}$ ions)

Sulfuric acid (concentrated, 98% solution, 40 mL/L)

Sodium hypophosphite (80 g/L)

Thiourea (80 g/L)

Polyvinyl pyrrolidone (PVP K30, 12 g/L of the solid powder; may be added as powder or as 40 mL of a 30 wt. % solution)

The four immersion tin plating compositions contained silver sulfate in a sufficient concentration to yield silver ions in the concentrations shown in the following table. Table 3 also shows the thickness of the tin coating layer and the whisker density after 3000 hours of storage at ambient temperature and environment.

TABLE 3

Effect of Silver Concentration on Whisker Density

| Composition | [$Ag^+$] in ppm | Thickness (micrometers) | Whisker Density |
|---|---|---|---|
| 68A | 0 | 0.91 | High |
| 68B | 6.1 | 1.03 | Medium |
| 68C | 12 | 0.95 | None |
| 68D | 18 | 0.92 | None |

Figure 2A:
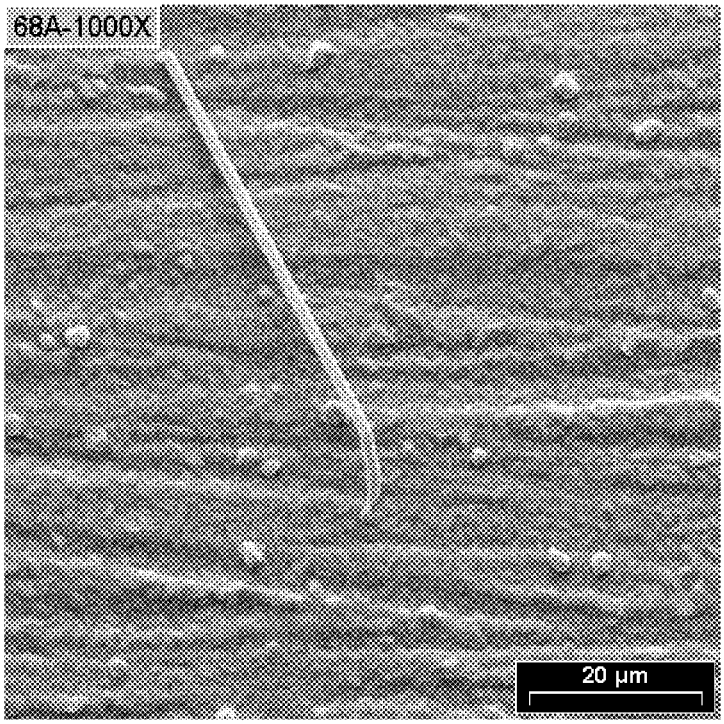
FIGS. 2A and 2B are SEM photomicrographs of tin-based coating layers at 1000× magnification after 2000 hours storage at room temperature.
Figure 2B:
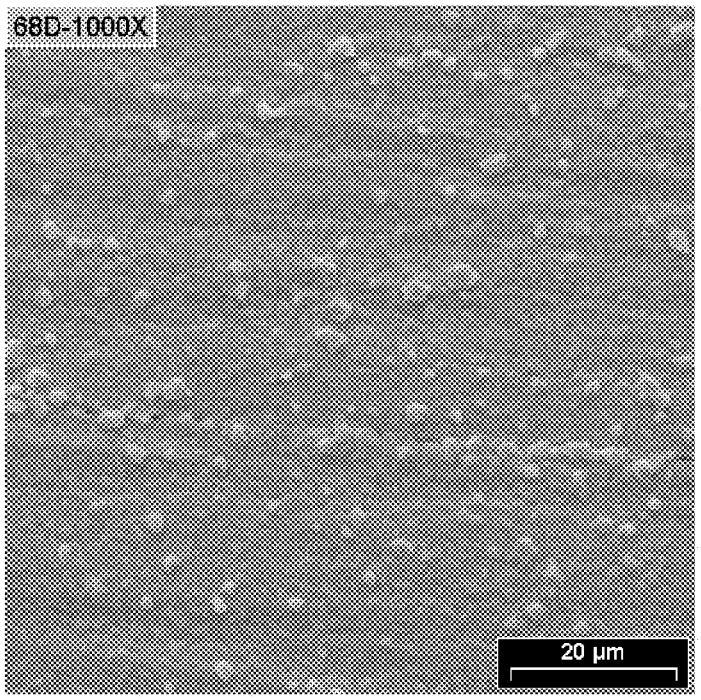

The whisker density data shows that the inclusion of low silver concentrations decreased the whisker density even after 3000 hours of aging in ambient conditions. While no whiskers were detected for all of the samples under initial inspections, a significant difference can be seen after 1000 hours. FIG. 1 is a graphical depiction of the whisker density range of tin coating layers deposited according to this Example 1 and several of the other Examples herein. The whisker density range remains unchanged in the ambient storage conditions up to 3000 hours, suggesting that the whisker density approaches equilibrium after an incubation period. A comparison between a tin-based coating layer having whiskers (from Composition 68A) and a tin-based coating layer having no detectable whiskers (from 68D) after 2000 hours of storage at 1000× magnification is seen in FIGS. 2A and 2B. FIG. 2A is an SEM image of the tin coating layer deposited from Composition 68A after 2000 hours storage at room temperature. FIG. 2B is an SEM photomicrograph of the tin coating layer deposited from Composition 68D after 2000 hours storage at room temperature.

Example 2

Whisker Length

Figure 3A:
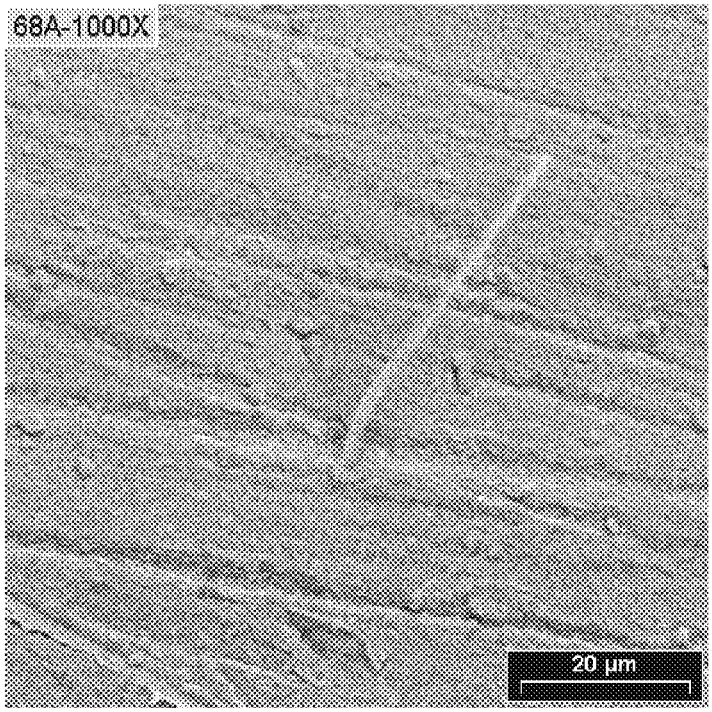
FIGS. 3A, 3B, and 3C are SEM photomicrographs (1000× magnification) that show the longest whiskers at various storage times. The images were obtained according to the method of Example 2.
Figure 3B:
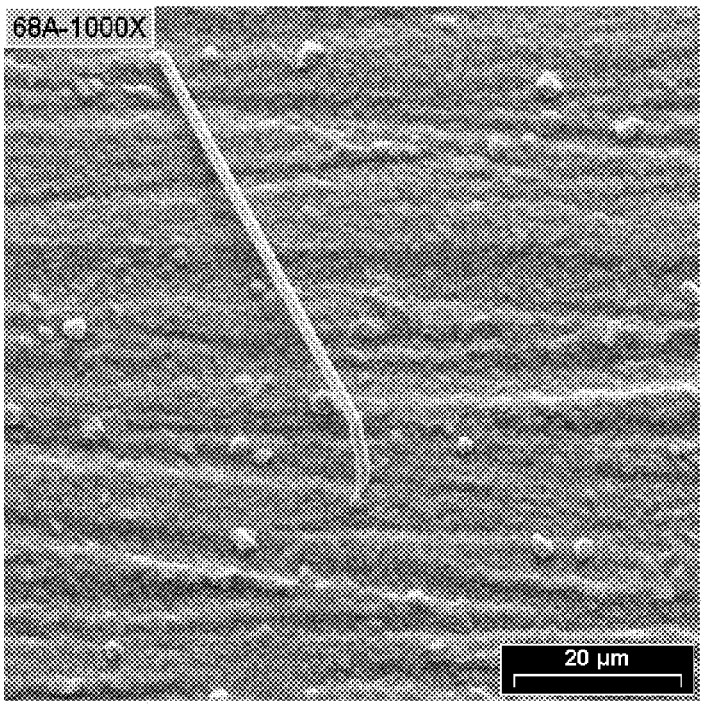
Figure 3C:
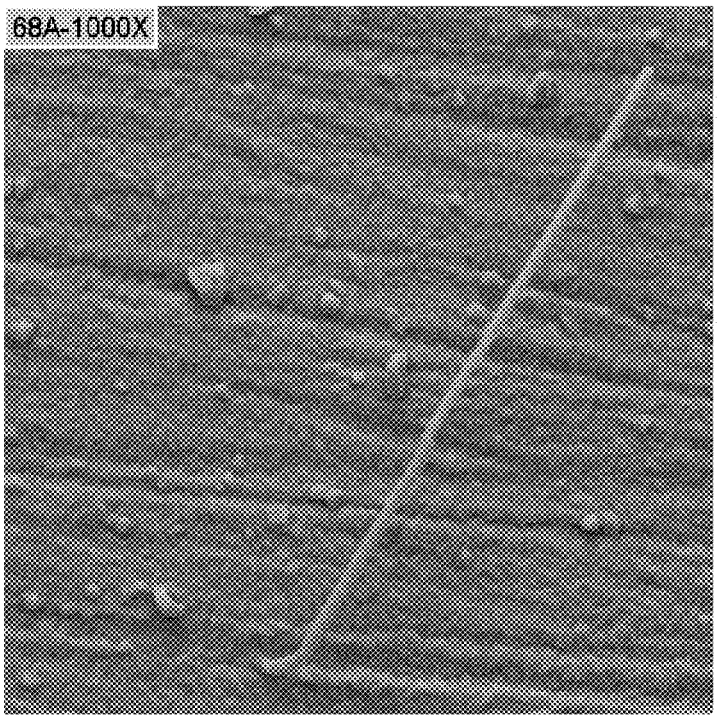

The maximum whisker length is another parameter often used to describe whisker propensity and risk. See B. D. Dunn, "Whisker Formations on Electronic Materials," Circuit World; 2(4):32-40, 1976. The longest whiskers were identified on the samples during screening inspection (200× magnification) and recorded during detailed inspection (1000× magnification). FIGS. 3A, 3B, and 3C are SEM photomicrographs (1000× magnification) that show the longest whiskers at storage times 1000 hours (FIG. 3A), 2000 hours (FIG. 3B), and 3000 hours (FIG. 3C), respectively, at the fixed area for the coupon plated with Composition 68A, which showed a High whisker density. It can be seen that the "longest" whisker grew with the storage time. The risk of tin whiskering is therefore based not only on the whisker density but also on the whisker length.

Example 3

Cross Sectional Analysis

Figure 4:
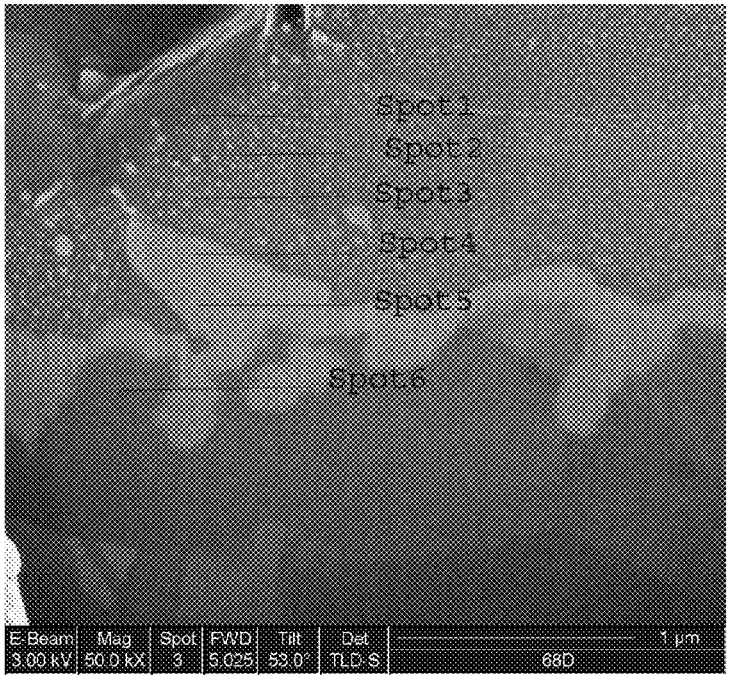
FIG. 4 is a cross-sectional SEM photomicrograph of the tin coating deposited on copper using composition 68D, which was obtained as described in Example 3.
Figure 5:
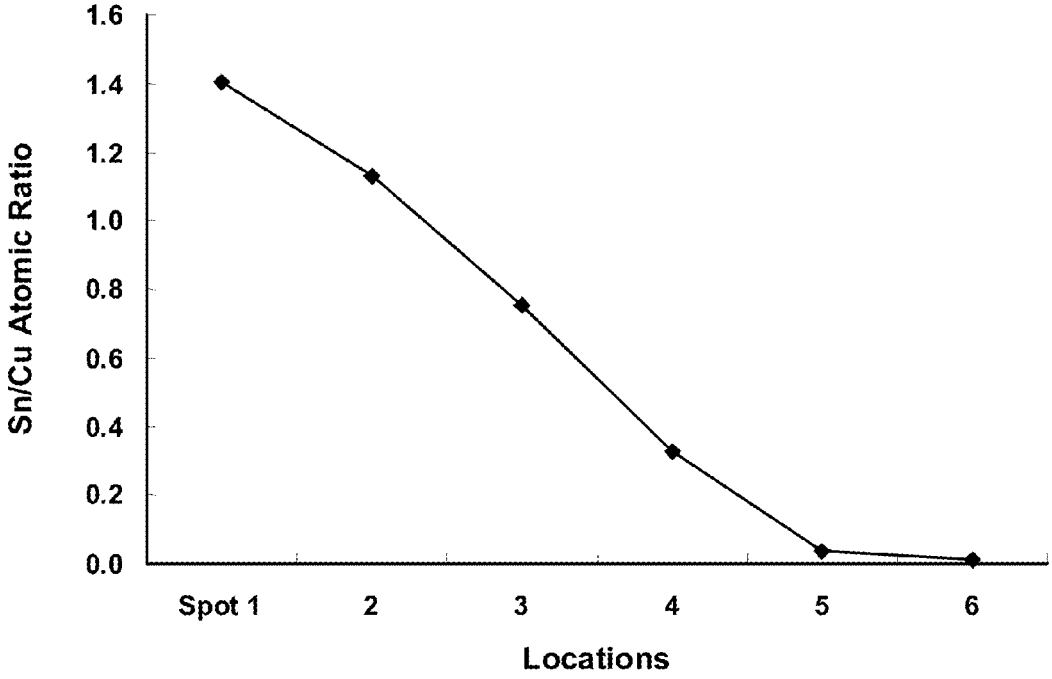
FIG. 5 is a graphical depiction of the Sn/Cu atomic ratio in a tin-based coating layer, which was obtained as described in Example 3.

The cross section of composition 68D which was whisker free after 5100 hours storage under ambient conditions was prepared by Focused Ion Beam (FIB) and examined by Energy Dispersive Spectroscopy (EDS). As shown in FIG. 4, which is a cross-sectional SEM photomicrograph of the tin coating layer deposited using composition 68D and after aging 5100 hours under ambient conditions, there are nanosize particles dispersed in the "free" tin, and the IMC layer is not uniform and displays a laminar structure within it. The atomic ratio of Sn/Cu gradually decreases in several spots vertically through the tin coating, IMC, and copper substrate, as shown in FIG. 5, which is a graphical depiction of the Sn/Cu atomic ratio. However, because the resolution of EDS was about 0.5 micrometers, which is relatively large compared to the total thickness of about 1 micrometer, and the sample was tilted 53°, this Sn/Cu ratio is only a qualitative estimation of the composition.

Example 4

Immersion Tin Plating and Compositions

Copper coupons were prepared for and subjected to immersion tin plating for nine minutes in each of four immersion tin silver plating compositions designated 70A, 70B, 70C, and 70D that were prepared with varying concentrations of silver ions added. The concentration of tin ions in the solution was decreased compared to Example 1's compositions, while the concentration of thiourea was increased. Moreover, glycolic acid was added to the compositions. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. Each of the four immersion tin plating compositions contained the following components in the concentrations shown:

Tin Sulfate (10.8 g/L, which provides about 6 g/L of $Sn^2$ ions)

Sulfuric acid (concentrated, 40 mL/L)

Sodium hypophosphite (80 g/L)

Thiourea (90 g/L)

Glycolic Acid (50 mL/L of a 70% solution)

Mixture of 1-methyl-2-pyrrolidone (80 wt. %) and polyvinyl pyrrolidone PVP K30 (20 wt. %) (12 g/L, provided by a 60 mL/L of a 20 wt. % solution).

The four immersion tin plating compositions contained silver sulfate in a sufficient concentration to yield silver ions in the concentrations shown in the following table. Table 4 also shows the thickness of the tin coating layer and the whisker density after 3000 hours of storage at ambient temperature and environment.

TABLE 4

Effect of Silver Concentration on Whisker Density

| Comp. | [$Ag^+$] in ppm | Silver content wt. % | Thickness (micrometers) | Whisker Density |
|---|---|---|---|---|
| 70A | 0 | 0 | 0.88 | Medium |
| 70B | 7.9 | 2.5 | 1.04 | Low |
| 70C | 16 | 5.0 | 1.08 | None |
| 70D | 24 | 8.3 | 0.99 | None |

The whisker density data shows that the inclusion of relatively low silver concentrations decreased the whisker density even after 3000 hours of aging in ambient conditions. Moreover, compared to the tin-based coating layers deposited according to the method described in Example 1, the inclusion of glycolic acid decreased the whisker density even in the absence of silver from the tin deposit.

Example 5

Immersion Tin Plating and Compositions

Copper coupons were prepared for and subjected to immersion tin plating for nine minutes in each of immersion tin plating compositions designated 71A and 71B. The concentration of tin ions in the solution was decreased compared to Example 1's compositions, while the concentration of thiourea was increased. Moreover, diethylene triamine pentaacetic acid (DTPA) was added to the compositions. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. Both immersion tin plating compositions contained the following components in the concentrations shown:

Tin Sulfate (10.8 g/L, which provides about 6 g/L of $Sn^{2+}$ ions)

Silver Sulfate (24 ppm of $Ag^+$ ions)

Sulfuric acid (concentrated, 40 mL/L)

Sodium hypophosphite (80 g/L)

Thiourea (90 g/L)

Diethylene triamine pentaacetic acid, DTPA (10 g/L)

Mixture of 1-methyl-2-pyrrolidone (80 wt. %) and polyvinyl pyrrolidone PVP K30 (20 wt. %) (12 g/L, provided by a 60 mL/L of a 20 wt. % solution).

Composition 71B additionally contained 2.2 g/L VEE GEE 100, Bloom Type B Gelatin (available from Vyse Gelatin Company), which acts as a grain refiner. Table 5 shows the thickness of the tin coating layer and the whisker density after 3000 hours of storage at ambient temperature and environment.

TABLE 5

Effect of Silver Concentration on Whisker Density

| Composition | Silver content wt. % | Thickness (micrometers) | Whisker Density |
|---|---|---|---|
| 71A | 17.0 | 0.84 | None |
| 71B | 11.1 | 1.01 | None |

Both compositions deposited tin-based coating layers that resisted whisker growth even after 3000 hours of aging in ambient conditions. The VEE GEE additive increased the coating thickness, but decreased the silver content of the deposited tin-based coating layer.

Example 6

Immersion Tin Plating and Compositions

Copper coupons were prepared for and subjected to immersion tin plating for nine minutes in an immersion tin plating composition designated 72A, which contained citric acid. This experiment was carried out to determine the effect of citric acid on plating rate and silver concentration in the tin coating layer. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. The immersion tin plating composition contained the following components in the concentrations shown:

Tin Sulfate (10.8 g/L, which provides about 6 g/L of $Sn^{2+}$ ions)

Silver Sulfate (24 ppm $Ag^+$ ions)

Sulfuric acid (concentrated, 98%, 40 mL/L)

Sodium hypophosphite (80 g/L)

Thiourea (90 g/L)

Citric acid (10 g/L)

Mixture of 1-methyl-2-pyrrolidone (80 wt. %) and polyvinyl pyrrolidone PVP K30 (20 wt. %) (12 g/L, provided by a 60 mL/L of a 20 wt. % solution).

The tin-based coating layer deposited from composition 72A contained 15.4 wt. % silver and had a total thickness of 0.92 micrometers after nine minutes of deposition. The tin-based coating layer resisted tin whisker formation after 3000 hours of storage in ambient conditions.

Example 7

Immersion Tin Plating and Compositions

Copper coupons were prepared for and subjected to immersion tin plating for nine minutes in an immersion tin plating composition designated 74B. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. The immersion tin plating composition contained the following components in the concentrations shown:

Tin Sulfate (10.8 g/L, which provides about 6 g/L of $Sn^{2+}$ ions)

Silver Sulfate (24 ppm Ag % ions)

Sulfuric acid (concentrated, 98%, 40 mL/L)

Sodium hypophosphite (80 g/L)

Thiourea (90 g/L)

Glycolic acid (100 mL/L of a 70% solution)

Polyvinyl pyrrolidone (PVP K30, 15 g/L)

The tin-based coating layer deposited from composition 74B contained 12.3 wt. % silver and had a total thickness of 1.14 micrometers after nine minutes of deposition. The tin silver alloy resisted tin whisker formation after 3000 hours of storage in ambient conditions and exhibited excellent adhesion to the substrate using a peeling test. The peel test is an industry used qualitative test to evaluate the coating adhesion by scotch tape-pull without a real standard. A rating of 0 to 5 is assigned depending on how much coating is peeled off by the scotch tape. The tin silver alloy of this Example scored a 5 on the peel test.

Example 8

Immersion Tin Plating and Compositions

Copper coupons were prepared for and subjected to immersion tin plating for nine minutes in each of three immersion tin plating compositions designated 69A, 69B, and 69C that were prepared with varying concentrations of silver ions added. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. Each of the immersion tin plating compositions contained the following components in the concentrations shown:

Tin Sulfate (12 g/L, to provide about 6.6 g/L of $Sn^2$ ions)

Sulfuric acid (concentrated, 98%, 40 mL/L)

Sodium hypophosphite (80 g/L)

Thiourea (80 g/L)

Mixture of 1-methyl-2-pyrrolidone (80 wt. %) and polyvinyl pyrrolidone PVP K30 (20 wt. %) (12 g/L, provided by a 60 mL/L of a 20 wt. % solution).

The immersion tin plating compositions contained silver sulfate in a sufficient concentration to yield silver ions in the concentrations shown in the following table. Table 6 also shows the thickness of the tin-based coating layer and the whisker density after 3000 hours of storage at ambient temperature and environment. The high degree of whisker density in 69B resulted from a longer etch, which was 2 minutes, as opposed to the standard etch of 1 minute. Each deposit exhibited high resistance to peeling.

TABLE 6

Effect of Silver Concentration on Whisker Density

| Composition | $[Ag^+]$ in ppm | Thickness (micrometers) | Whisker Density |
|---|---|---|---|
| 69A | 0 | 0.76 | Medium |
| 69B | 0 | 0.91 | High |
| 69C | 16 | 0.88 | None |

Example 9

Immersion Tin Plating and Compositions

Copper coupons were prepared for and subjected to immersion tin plating for nine minutes in each of two immersion tin plating compositions designated 73A and 73B that were prepared with varying concentrations of sulfur-based complexing agent added, while the silver ion content was the same in both compositions. In these two solutions, N-allyl-N'-β-hydroxyethyl-thiourea ("HEAT" in the Table) was added in addition to thiourea. Prior to immersion tin plating, the copper coupons were pre-dipped in a composition comprising sulfuric acid (2% concentration) at a temperature of 24° C. The immersion tin plating compositions were held at a temperature of about 70° C. during immersion tin silver plating. Each of the immersion tin plating compositions contained the following components in the concentrations shown:

Tin Sulfate (10.8 g/L, which provides about 6 g/L of $Sn^{2+}$ ions)

Silver Sulfate (23 ppm of $Ag^+$ ions)

Sulfuric acid (concentrated, 98%, 40 mL/L)

Sodium hypophosphite (80 g/L)

Thiourea (90 g/L)

Mixture of 1-methyl-2-pyrrolidone (80 wt. %) and polyvinyl pyrrolidone PVP K30 (20 wt. %) (12 g/L, provided by a 60 mL/L of a 20 wt. % solution).

Table 7 shows the concentration of N-allyl-N'-β-hydroxyethyl-thiourea ("HEAT") added to each solution as well as the silver content of the tin-based coating layers, the thicknesses of the tin-based coating layers, and the whisker densities after 3000 hours of storage at ambient temperature and environment.

TABLE 7

Effect of Silver Concentration on Whisker Density

| Comp. | HEAT, g/L | Silver content in alloy, wt. % | Thickness (micrometers) | Whisker Density |
|---|---|---|---|---|
| 73A | 3.3 | 16.0 | 0.94 | None |
| 73B | 10 | 9.9 | 1.00 | None |

Example 10

Immersion Tin Plating Compositions

Copper coupons were prepared for and subjected to immersion tin plating for nine minutes in each of three immersion tin plating compositions designated 77A, 77B, and 77C that were prepared with varying the concentration of silver ion and by adding a polyvinyl pyrrolidone polymer. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. Each of the immersion tin plating compositions contained the following components in the concentrations shown:

Tin Sulfate (10.6 g/L, which provides about 5.9 g/L of $Sn^2$ ions)

Sulfuric acid (concentrated, 98%, 40 mL/L)

Sodium hypophosphite (80 g/L)

Thiourea (90 g/L)

Polyvinyl pyrrolidone (PVP K30, 40 g/L)

The immersion tin plating compositions contained silver sulfate in a sufficient concentration to yield silver ions in the concentrations shown in the following table. Table 8 also shows the silver content of the tin-silver deposits, the thickness of the tin-silver layer, and the whisker density after 3000 hours of storage at ambient temperature and environment. Each deposit exhibited high resistance to peeling from the substrate.

TABLE 8

Effect of Silver Concentration on Whisker Density

| Comp. | PVP K60, 30% soln, g/L | $[Ag^+]$ in ppm | Silver content in alloy, wt. % | Thickness (micrometers) | Whisker Density |
|---|---|---|---|---|---|
| 77A | 0 | 0 | 0 | 1.01 | Low |
| 77B | 40 | 0 | 0 | 1.43 | Low |
| 77C | 40 | 7.9 | 1.6 | 1.43 | Low |

Example 11

Immersion Tin Plating

Figure 6A:
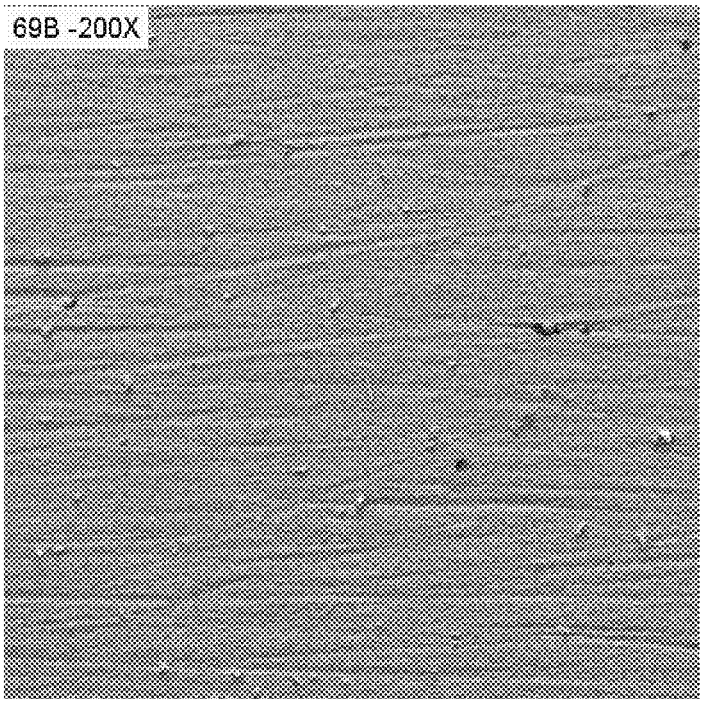
FIGS. 6A (200× magnification) and 6B (1000× magnification) show a tin-based coating layer deposited from Composition 69B that had a high density of whiskers (>45 whiskers/$mm^2$). These images were obtained according to the method described in Example 11.
Figure 6B:
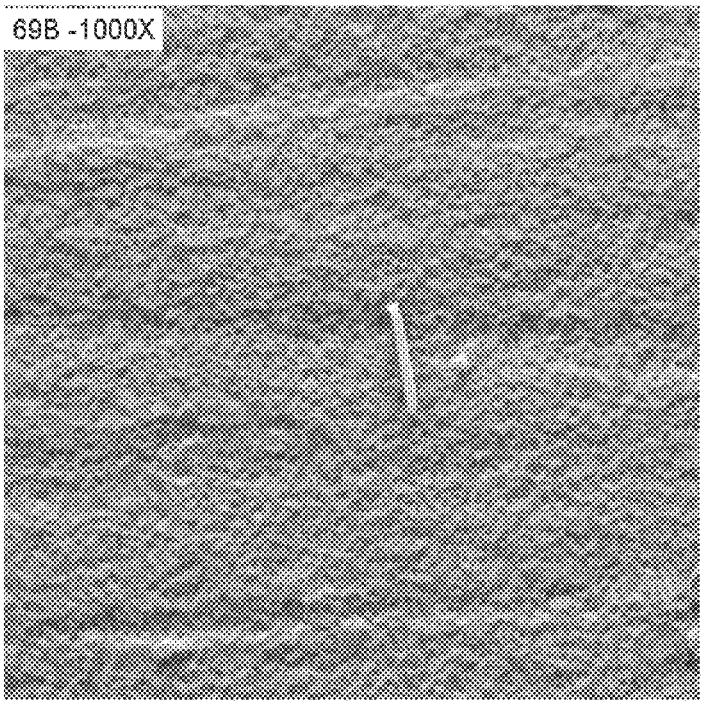
Figure 7A:
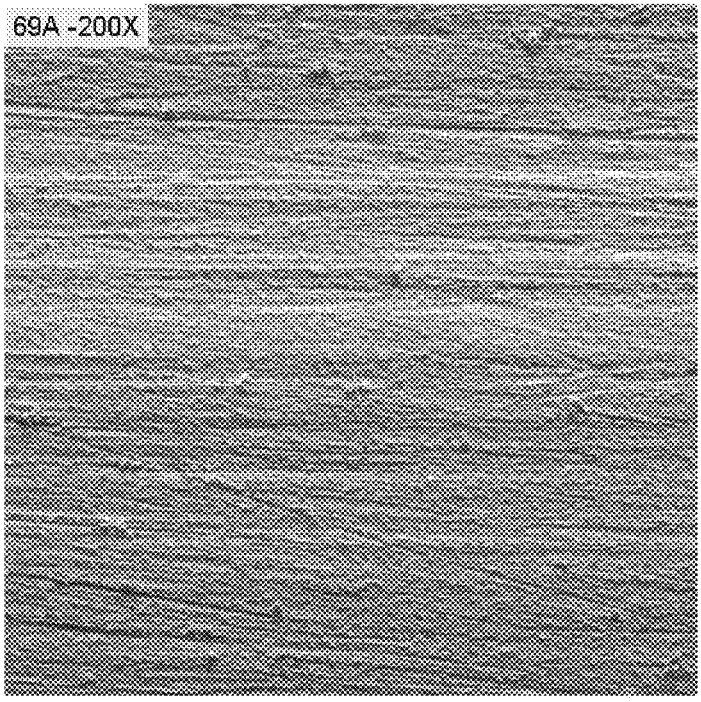
FIGS. 7A (200× magnification) and 7B (1000× magnification) show a tin-based coating layer deposited from Composition 69A that had a medium density of whiskers (10-45 whiskers/$mm^2$). These images were obtained according to the method described in Example 11.
Figure 7B:
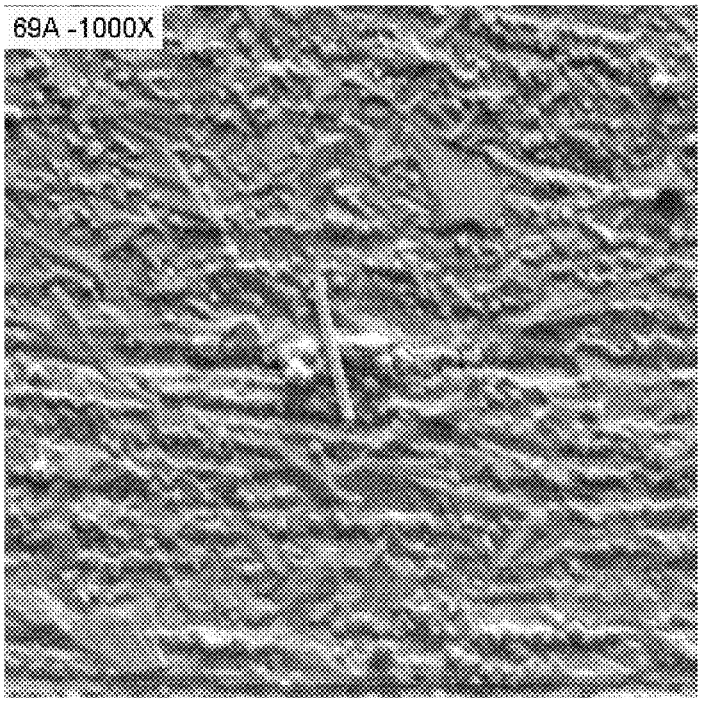
Figure 8A:
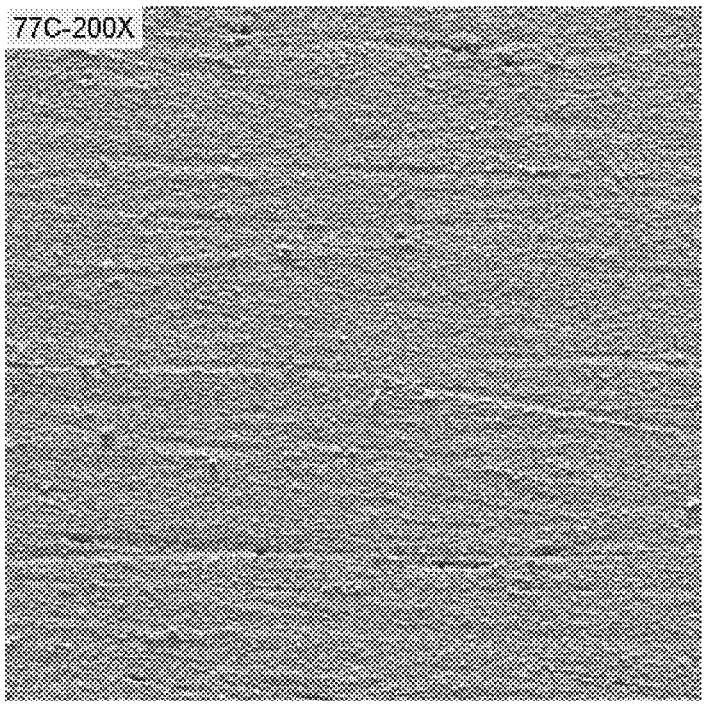
FIGS. 8A (200× magnification) and 8B (1000× magnification) show a tin-based coating layer deposited from Composition 77C that had a low density of whiskers (1-10 whiskers/$mm^2$). These images were obtained according to the method described in Example 11.
Figure 8B:
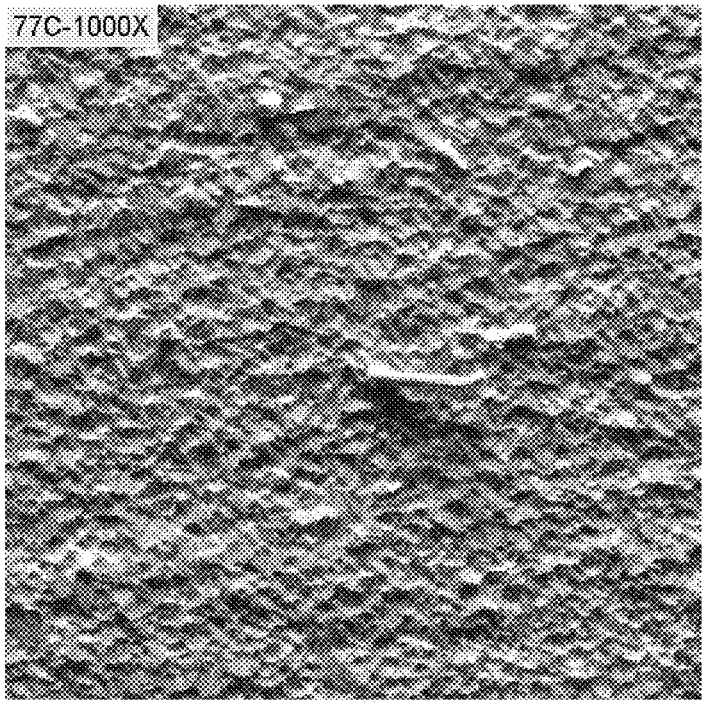
Figure 9A:
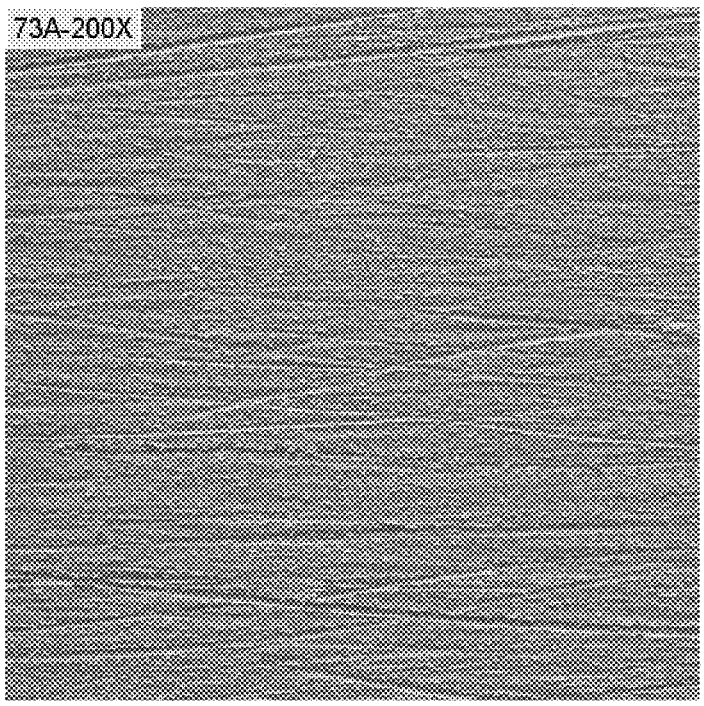
FIGS. 9A (200× magnification) and 9B (1000× magnification) show a tin-based coating layer deposited from Composition 73A that was free of whiskers (0/$mm^2$). These images were obtained according to the method described in Example 11.
Figure 9B:
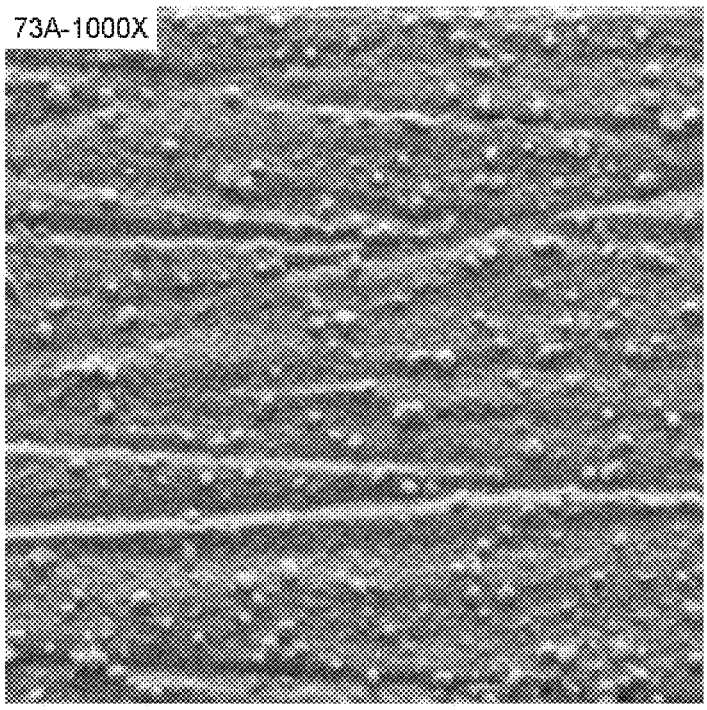

The copper coupons that were plated with tin coating layers using the compositions of Examples 8, 9, and 10 were subjected to 3000 hours of aging at ambient temperature and environment. FIGS. 6A (200× magnification) and 6B (1000× magnification) show a tin-based coating layer deposited from Composition 69B that had a high density of whiskers (>45 whiskers/mm$^2$). FIGS. 7A (200× magnification) and 7B (1000× magnification) show a tin-based coating layer deposited from Composition 69B that had a medium density of whiskers (10-45 whiskers/mm$^2$). FIGS. 8A (200× magnification) and 8B (1000× magnification) show a tin-based coating layer deposited from Composition 77C that had a low density of whiskers (1-10 whiskers/mm$^2$). FIGS. 9A (200× magnification) and 9B (1000× magnification) show a tin-based coating layer deposited from Composition 69C that was free of whiskers (0/mm$^2$).

Example 12

Immersion Tin Plating and Compositions

Copper coupons were prepared for and subjected to immersion tin plating for nine minutes in each of two immersion tin plating compositions designated 80B and 80C. Prior to immersion tin plating, the copper coupons were pre-dipped in a composition comprising sulfuric acid (2% concentration) at a temperature of 24° C. The immersion tin plating compositions were held at a temperature of about 70° C. during immersion tin plating. The immersion tin plating compositions contained the following components in the concentrations shown:

Tin Sulfate (10.0 g/L, which provides about 5.5 g/L of Sn$^2$% ions)

Silver Sulfate (16 ppm $Ag^+$ ions)

Sulfuric acid (concentrated, 98%, 40 mL/L)

Sodium hypophosphite (80 g/L)

Thiourea (90 g/L)

Polyvinyl pyrrolidone (PVP K30, 13 g/L)

Example 13

Whisker Resistance to Thermal Cycle

Figure 10A:
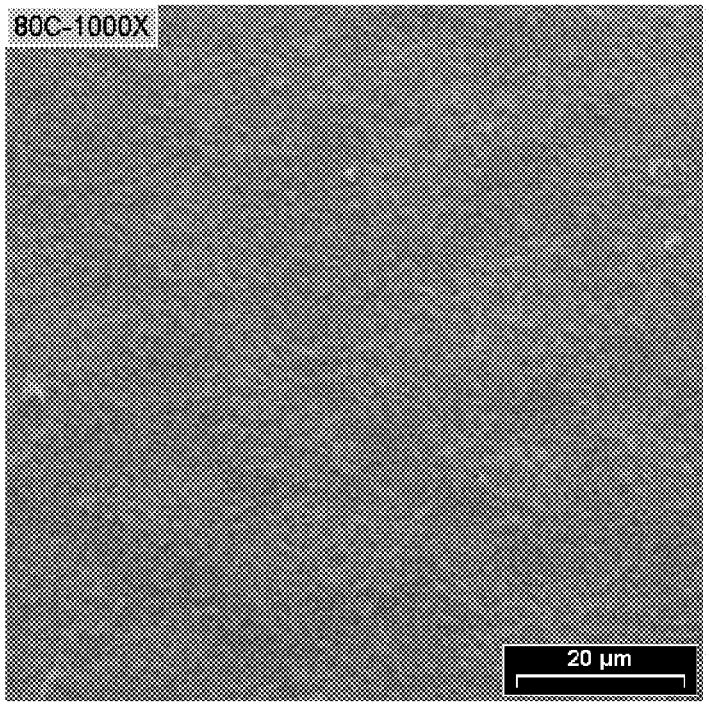
FIGS. 10A and 10B are SEM photomicrographs at 1000× magnification, showing the absence of tin whiskers after 3000 thermal cycles and one lead-free reflow (FIG. 10A) and two lead-free reflows (FIG. 10B). These images were obtained according to the method described in Example 13.
Figure 10B:
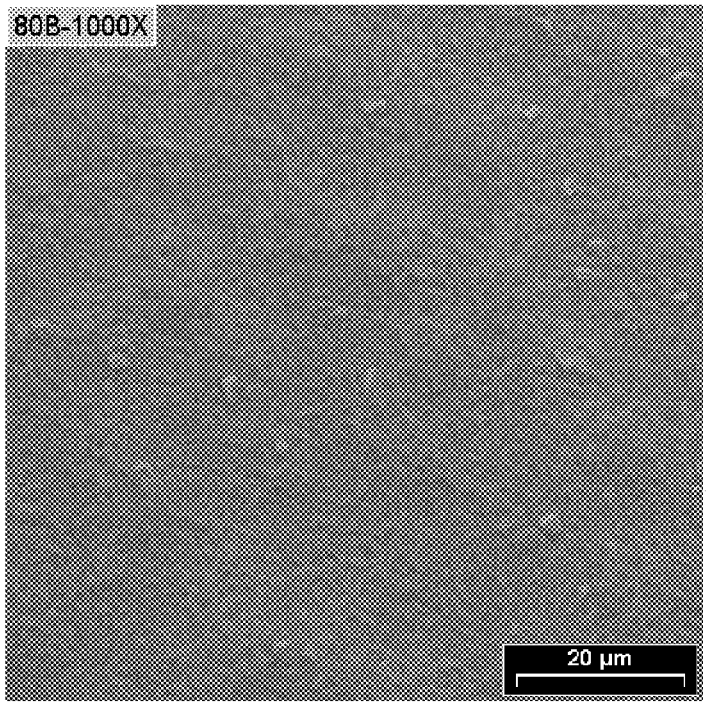

The immersion tin plating compositions of Example 12 where used to deposit tin-based coating layers to an approximate thickness of 1.10 micrometers on copper coupons. The tin-coated copper coupons were subjected to 3000 thermal cycles as described above and then to two lead free reflows, as also described above. FIGS. 10A and 10B are SEM photomicrographs at 1000× magnification, showing the absence of tin whiskers after 3000 thermal cycles and one lead-free reflow (FIG. 10A) and two lead-free reflows (FIG. 10B). Other than some tiny nodules that are characteristic of immersion tin, no whiskers can be found.

In view of the empirical results of the above Examples, the following conclusions may be drawn (1) Both whisker density and maximum whisker length are required to describe whiskering propensity.

Figure 11:
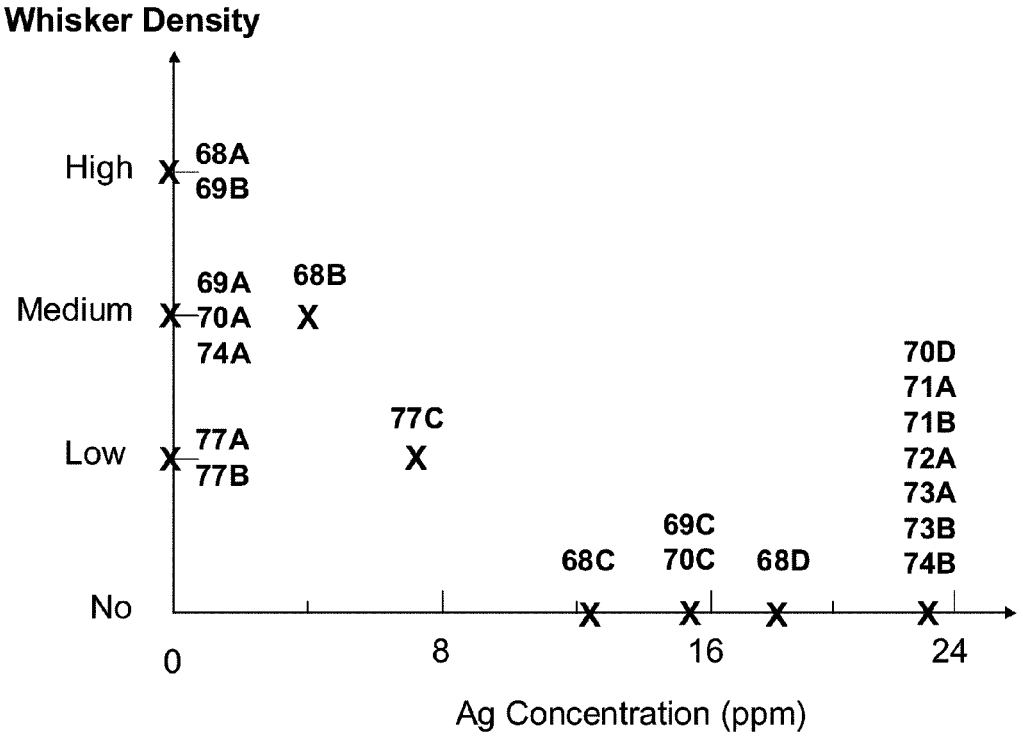
FIG. 11 is a graphical depiction of the effect of silver ion concentration on whisker density of tin-based coating layers deposited according to method of the present invention.

(2) Immersion tin-based coating layers deposited according to the method of the present invention are free of whiskers after 3000 hours aging in ambient conditions and 3000 thermal cycles. In one respect, the silver ion concentration influenced the whisker growth behavior after aging, as shown in FIG. 11.

(3) The thickness of the immersion tin-based coating layers deposited according to the method of the present invention is dependent upon the roughness of the copper surface. As the roughness increases, the tin crystal size and the thickness of the tin coatings increase.

(4) Immersion tin coatings deposited according to the method of the present invention are capable of maintaining robust solderability after conditioning through fifteen lead-free reflow cycles.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

What is claimed is:

1. A method for depositing a whisker resistant tin-based coating layer on a surface of a copper substrate, the method comprising:

contacting the surface of the copper substrate selected from the group of substrates consisting of copper on a printed wiring board, lead frames in electronic devices, connectors in electronic devices, and die pads in under bump metallization with an immersion tin plating composition comprising the following to thereby form, by displacement plating reaction between $Sn^{2+}$ ions and Cu metal of the substrate, a tin-based coating comprising at least 80 wt % Sn:

a source of $Sn^{2+}$ ions sufficient to provide a concentration of $Sn^{2+}$ ions between about 5 g/L and about 20 g/L;

a source of $Ag^+$ ions sufficient to provide a concentration of $Ag^+$ ions between about 10 ppm and about 24 ppm;

a source of sulfur-based complexing agent sufficient to provide a concentration of sulfur-based complexing agent between about 60 g/L and about 120 g/L;

a source of hypophosphite ion in an amount sufficient to enhance the rate of deposition, wherein the amount of hypophosphite ion is equivalent to that provided by between 70 g/L and about 100 g/L of sodium hypophosphite;

in addition to the hypophosphite source, a source of anti-oxidant sufficient to provide a concentration of anti-oxidant between about 30 g/L and about 110 g/L;

a source of pyrrolidone sufficient to provide a concentration of pyrrolidone of at least about 12 g/L; and an acid in a concentration sufficient to lower the pH of the composition between about 0 and about 5, wherein the tin-based coating layer that is deposited onto the copper substrate surface by the immersion tin plating composition has a thickness between 0.5 micrometers and 1.5 micrometers.

2. The method of claim 1 wherein the source of $Ag^+$ ions is sufficient to provide a concentration of $Ag^+$ ions between about 12 ppm and about 24 ppm.

3. The method of claim 1 wherein the source of $Ag^+$ ions is sufficient to provide a concentration of $Ag^+$ ions between about 12 ppm and about 20 ppm.

4. The method of claim 1 wherein the source of $Ag^+$ ions is sufficient to provide a concentration of $Ag^+$ ions between about 10 ppm and about 16 ppm.

5. The method of claim 1 wherein the source of $Sn^{2+}$ ions is sufficient to provide a concentration of $Sn^{2+}$ ions between about 6 g/L and about 12 g/L.

6. The method of claim 1 wherein the source of $Sn^{2+}$ ions is sufficient to provide a concentration of $Sn^{2+}$ ions between about 6 g/L and about 10 g/L.

7. The method of claim 1 wherein the source of pyrrolidone comprises polyvinylpyrrolidone.

8. The method of claim 1 wherein the source of pyrrolidone comprises polyvinylpyrrolidone and 1-methyl-2-pyrrolidone.

9. The method of claim 1 wherein the anti-oxidant is sufficient to provide a concentration between about 40 g/L and about 80 g/L.

10. The method of claim 1 wherein contacting the surface of the copper substrate with the immersion tin plating composition causes the oxidation of copper into copper ions.

11. The method of claim 10 wherein additional sulfur-based complexing agent is added to the immersion tin plating composition at a rate of between about 3 g/L and about 9 g/L complexing agent per 1 g of copper ion/L buildup.

12. The method of claim 1 wherein the source of pyrrolidone is sufficient to provide a concentration of pyrrolidone from about 12 g/L to about 18 g/L.

13. The method of claim 1 wherein said contact deposits the tin-based coating layer to a thickness between 0.7 micrometers and 1.2 micrometers.

14. The method of claim 1 wherein said contact deposits the tin-based coating layer to a thickness between 0.7 micrometers and 1.0 micrometers.

15. The method of claim 1 wherein the source of hypophosphite ion comprises sodium hypophosphite.

16. The method of claim 1 wherein the tin-based coating layer remains solderable through at least about 5 lead-free reflow cycles.

* * * * *